US005909200A

United States Patent [19]

Hush

[11] Patent Number: 5,909,200

[45] Date of Patent: Jun. 1, 1999

[54] TEMPERATURE COMPENSATED MATRIX ADDRESSABLE DISPLAY

[75] Inventor: Glen E. Hush, Boise, Id.

[73] Assignee: Micron Technology, Inc., Boise, Id.

[21] Appl. No.: 08/726,292

[22] Filed: Oct. 4, 1996

[51] Int. Cl.[6] ..... G09G 3/22

[52] U.S. Cl. ..... 345/74; 345/214

[58] Field of Search ..... 345/74, 75, 214; 315/169.1, 169.4

[56] References Cited

U.S. PATENT DOCUMENTS

| | | | |
|---|---|---|---|
| 3,705,316 | 12/1972 | Burrous et al. | 327/513 |
| 3,761,617 | 9/1973 | Tsuchiya et al. | 178/7.3 D |
| 3,883,778 | 5/1975 | Kaji et al. | 315/205 |
| 4,020,280 | 4/1977 | Kaneko et al. | 358/242 |
| 4,438,348 | 3/1984 | Casper et al. | 327/513 |
| 4,694,157 | 9/1987 | Mishina | 250/214 |
| 4,743,096 | 5/1988 | Wakai et al. | 350/333 |
| 5,103,144 | 4/1992 | Dunham | 315/366 |
| 5,153,483 | 10/1992 | Kishino et al. | 315/3 |
| 5,168,294 | 12/1992 | Davis et al. | 353/122 |
| 5,196,839 | 3/1993 | Johary et al. | 340/793 |
| 5,210,472 | 5/1993 | Casper et al. | 315/349 |
| 5,212,426 | 5/1993 | Kane | 315/169.1 |
| 5,231,315 | 7/1993 | Thelen, Jr. | 327/103 |
| 5,262,698 | 11/1993 | Dunham | 315/169.1 |
| 5,283,500 | 2/1994 | Kochanski | 315/58 |
| 5,359,256 | 10/1994 | Gray | 313/169 |
| 5,387,844 | 2/1995 | Browning | 315/169.3 |
| 5,404,081 | 4/1995 | Kane et al. | 315/169.1 |
| 5,581,159 | 12/1996 | Lee et al. | 315/167 |

OTHER PUBLICATIONS

Cathey, David A., Jr. "Field Emission Displays"<no citation information>.

Lee, Kon Jiun "Current Limiting of Field Emitter Array Cathodes"pp. 88–156 of Ph.D. Thesis, Georgia Institute of Technology, 1986.

Yokoo, K.; Arai, M.; Mori, M.;Bae, J.; Ono, S. "Active Control of Emission Current," *Revuew Le Vide, les Couches Minces* Suppl. No. 271: 58–61, Mar./Apr., 1994.

*Primary Examiner*—Steven J. Saras
*Assistant Examiner*—Thu Nguyen
*Attorney, Agent, or Firm*—Seed and Berry LLP

[57] ABSTRACT

A current controlled field emission display includes a current control circuit coupled to respective emitters to control current flow through the emitters. The control circuit includes a limiting resistor to limit the current flow to the emitters. To compensate for temperature or other variations in the resistance of the limiting resistor, the control circuit also includes a compensating resistor that produces an offsetting change in a driving voltage within the control circuit. As the resistance of the limiting resistance drops, which would allow the current through the emitter to increase, the compensating resistor produces an offsetting voltage drop that increases the voltage across the limiting resistance to maintain the current through the limiting resistance constant. The offsetting current reduction thus reduces the overall effect of temperature on current flowing through the emitter set.

16 Claims, 3 Drawing Sheets

TEMPERATURE COMPENSATED MATRIX ADDRESSABLE DISPLAY

STATEMENT AS TO GOVERNMENT RIGHTS

This invention was made with government support under Contract No. DABT-63-93-C-0025 by Advanced Research Projects Agency ("ARPA"). The government has certain rights to this invention.

TECHNICAL FIELD

The present invention relates to matrix addressable displays, and more particularly to current control circuits in matrix addressable displays.

BACKGROUND OF THE INVENTION

Flat panel, matrix addressable displays are widely used in a variety of applications, including computer displays. One type of matrix addressable display well-suited for such applications is the field emission display. Field emission displays typically include a generally planar substrate having an array of projecting emitters. In many cases, the emitters are conical projections integral to the substrate. Typically, the emitters are grouped into emitter sets where the bases of the emitters in each set are commonly connected.

A conductive extraction grid is positioned above the emitters and driven with a voltage of about 30–120 V. The emitter sets are then selectively activated by providing a current path from the bases to the ground. Providing a current path to ground allows electrons to flow from the emitters in response to the extraction grid voltage. If the voltage differential between the emitters and extraction grid is sufficiently high, the resulting electric field extracts electrons from the emitters.

Field emission displays also include display screens mounted adjacent the substrates. The display screens are formed from glass plates coated with a transparent conductive material to form an anode biased to about 1–2 kV. A cathodoluminescent layer covers the exposed surface of the anode. The emitted electrons are attracted by the anode and strike the cathodoluminescent layer, causing the cathodoluminescent layer to emit light at the impact site. The emitted light then passes through the anode and the glass plate where it is visible to a viewer.

The brightness of the light produced in response to the emitted electrons depends, in part, upon the rate at which electrons strike the cathodoluminescent layer, which in turn depends upon the magnitude of current flow to the emitters. The brightness of each area can thus be controlled by controlling the current flow to the respective emitter set. By selectively controlling the current flow to the emitter sets, the light from each area of the display can be controlled and an image can be produced. The light emitted from each of the areas thus becomes all or part of a picture element or "pixel."

One problem with the above-described approach is that the response of the emitters sets and control circuitry vary. One cause of such variation may be environmental factors such as temperature. For example, the components of the control circuitry can have temperature-dependent electrical characteristics such as resistance and current leakage. For a given electrical input, the brightness of the emitted light may then vary according to the temperature in and around the display.

SUMMARY OF THE INVENTION

A matrix addressable field emission display includes a temperature-compensated current control circuit. In one embodiment of the invention, the control circuit includes a driving transistor and limiting resistor serially coupled between an emitter and ground. The driving transistor and limiting resistor form a controllable current path to control current flow through the emitter. The control circuit also includes a pass transistor coupled between a column line and the driving transistor to couple a variable amplitude column signal $V_{COL}$ to the gate of the driving transistor.

The gate of the control transistor is driven by a fixed amplitude, pulsed row signal $V_{ROW}$. The row signal $V_{ROW}$ turns ON the pass transistor to provide a sample of the column signal $V_{COL}$ to the gate of the driving transistor. When the row signal $V_{ROW}$ returns low, the pass transistor turns OFF, trapping the sample of the column signal $V_{COL}$ on a node between the pass transistor and the driving transistor. The node voltage $V_N$ establishes the gate voltage of the driving transistor, thereby establishing the source voltage $V_S$ of the driving transistor equal to the node voltage $V_N$ minus the threshold voltage $V_T$ of the driving transistor. The source voltage $V_S$ establishes current through the limiting resistor and thus through the emitter.

To offset variations in resistance of the limiting resistor caused by temperature, the control circuit also includes a compensating resistor coupled between the node and a reference potential. The compensating resistor has a high resistance to produce a controlled decay of the node voltage $V_N$ over a refresh interval of the emitter. The compensating resistor is structured such that the temperature response of the compensating resistor resistance tracks the temperature response of the limiting resistance.

As the limiting resistance increases due to temperature or other factors, the current through the emitter tends to decrease. At the same time, however, the resistance of the compensating resistor increases, reducing the decay rate of the node voltage $V_N$ and thus reducing the decay rate of the source voltage $V_S$. Consequently, the average source voltage $V_S$ increases in response to the temperature change. The increased compensating resistance thus produces an increase in the average emitter current that offsets the effect of the increased limiting resistance.

Similarly, when the limiting resistance decreases, the current through the emitter tends to increase. However, the resistance of the compensating resistor also decreases, increasing the decay rate of the node voltage $V_N$, and thus increasing the decay rate of the source voltage $V_S$.

Consequently, the average source voltage $V_S$ increases in response to the temperature change. The decreased compensating resistance produces a decrease in the emitter current that offsets the effect of the decreased limiting resistance.

DETAILED DESCRIPTION OF THE INVENTION

Figure 1:
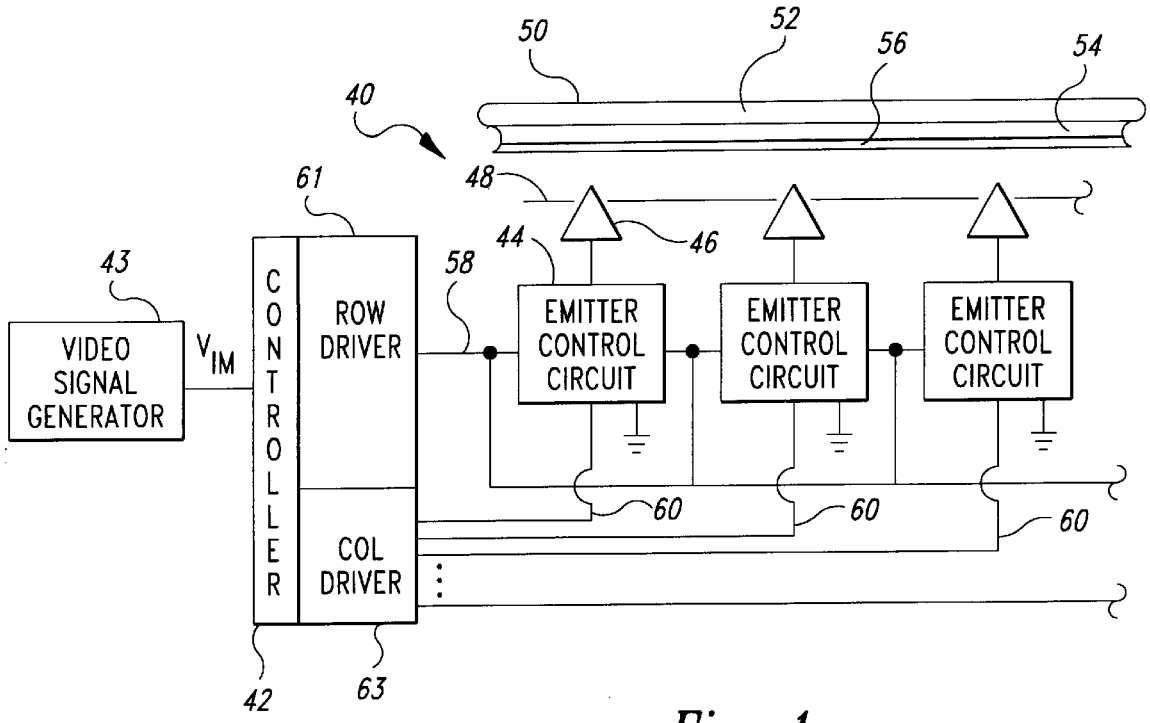
FIG. 1 is a block diagram of a portion of a field emission display according to the preferred embodiment of the invention showing a group of three emitters controlled by respective column and row driver circuits.

As shown in FIG. 1, a display device 40, which may be a television, computer display, or similar device, includes an electronic controller 42 driven by an image signal $V_{IM}$ from a video signal generator 43. The video signal generator 43 may be, for example, a television receiver, a computer, a camcorder, a VCR, etc. In response to the image signal $V_{IM}$ the controller 42 controls an array of emitter current control circuits 44, each coupled to a respective emitter 46. Although a single emitter 46 is coupled to each emitter control circuit 44 in FIG. 1, it will be understood that the emitter 46 may represent a set of commonly connected emitters. The current through each emitter 46 can be controlled independently, because a separate control circuit 44 couples to each emitter 46. While the array is represented by only three control circuits 44 and emitters 46 for clarity of presentation, it will be understood that typical arrays include several hundred control circuits 44 and sets of emitters 46 arranged in rows and columns.

The emitters 46 are aligned with respective openings in an extraction grid 48 adjacent a screen 50. The extraction grid 48 is a conventional extraction grid formed as a planar conductor having several holes, each aligned with a respective emitter 46. The screen 50 is a conventional screen formed from a glass plate 52 coated with a transparent, conductive anode 54 which is coated, in turn, by a cathodoluminescent layer 56.

During typical operation, the extraction grid 48 is biased to approximately 30–100 V and the anode 54 is biased to approximately 1–2 kV. A row driver 61 and column driver 63 within the controller 42 activate selected ones of the emitters 46 by selectively controlling the respective control circuits 44 through row lines 58 and column lines 60. The control circuits 44 activate the emitters 46 by connecting the emitters 46 to a bias voltage or ground which allows electrons to flow to the emitters 46. The extraction grid 48 extracts the provided electrons by creating a strong electric field between the extraction grid 48 and the emitter 46. In response, the emitter 46 emits electrons that are attracted by the anode 54. The electrons travel toward the anode 54 and strike the cathodoluminescent layer 56, causing light emission at the impact site. Because the intensity of the emitted light corresponds in part to the number of electrons striking the cathodoluminescent layer 56 during a given activation interval, the intensity of light can be controlled by controlling electron flow to the emitters 46.

Figure 2:
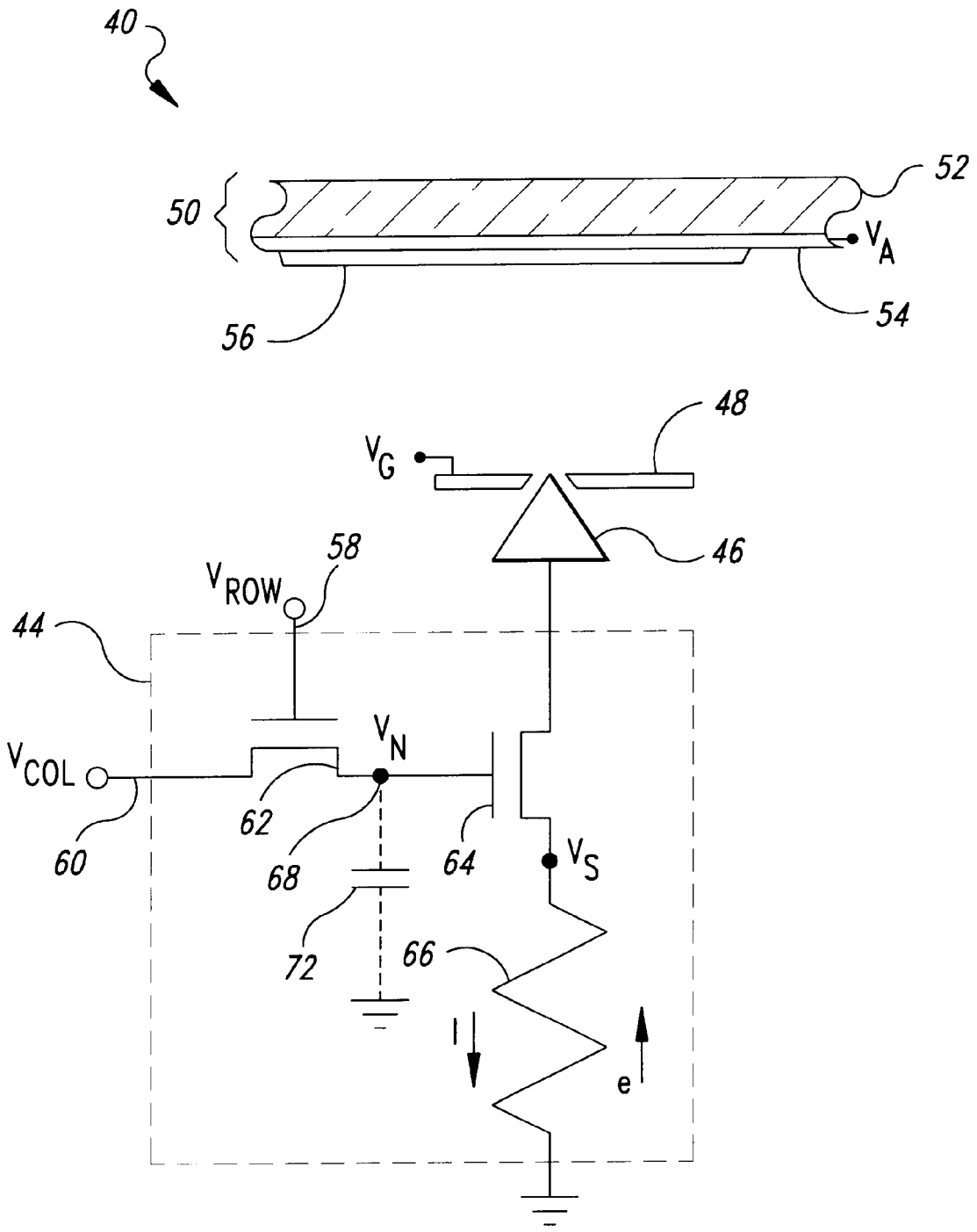
FIG. 2 is a schematic of a current control circuit coupled to an emitter set in the display of FIG. 1 with no temperature compensating resistor.

One approach to controlling electron flow to the emitters 46 is presented in FIG. 2, where the control circuit 44 includes a pass transistor 62, a driving transistor 64, and a limiting resistor 66. The driving transistor 64 and limiting resistor 66 are serially connected between the emitter 46 and ground to provide a current path that can supply electrons to the emitter 46. The pass transistor 62 is coupled between one of the column lines 60 and the gate of the driving transistor 64 to control the driving transistor 64. The gate of the pass transistor is controlled by a row signal $V_{ROW}$ (FIG. 2) from one of the row lines 58.

Operation of the circuit of FIG. 2 is best explained with reference to the signal timing diagrams of FIG. 3. As can be seen in the second signal timing diagram of FIG. 3, the input to the pass transistor 62 is a pulsed column signal $V_{COL}$ having a variable amplitude. A pulse of the column signal $V_{COL}$ is applied to the pass transistor 62 at time $t_1$, and a new pulse is applied every refresh interval T. The column signal $V_{COL}$ is developed in the controller 42 (FIG. 1) by sampling an input image signal $V_{IM}$. Thus, the column signal $V_{COL}$ has a variable amplitude derived from the amplitude of the image signal $V_{IM}$.

Figure 3:
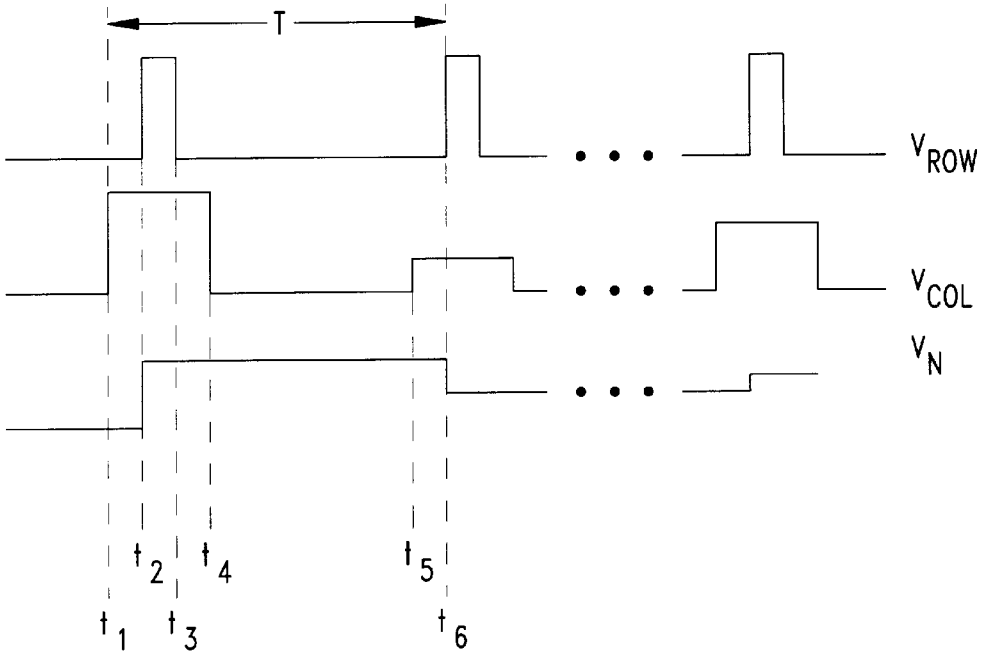
FIG. 3 is a signal timing diagram showing row and column signals and node voltage within the current control circuit of FIG. 2.

As shown in the uppermost graph of FIG. 3, shortly after the pulse of the column signal $V_{COL}$ arrives, the row signal $V_{ROW}$ goes high to turn ON the pass transistor 62 at time $t_2$. The ON pass transistor 62 transmits the column signal $V_{COL}$ to the gate of the driving transistor 64. The column signal $V_{COL}$ transmitted by the pass transistor 62 raises the voltage $V_N$ of a node 68 between the source of the pass transistor 62 and the gate of the driving transistor 64, as shown in the lower timing diagram of FIG. 3.

In response to the increased node voltage $V_N$, the driving transistor 64 turns ON and allows electrons to flow from ground, through the limiting resistor 66, to the emitter 46. The electrons are extracted by the extraction grid 48 and travel to the screen 50 to produce light, as described above.

The rate at which electrons are emitted depends upon the resistance of the limiting resistor 66, the node voltage $V_N$, and the threshold voltage $V_T$ of the driving transistor 64. When the node voltage $V_N$ rises, current I flows from the emitter 46 through the limiting resistor 66 (current direction is opposite to direction of electron flow). The source voltage $V_S$ of the driving transistor 64 then rises due to the voltage drop across the limiting resistor 66. The current I increases until the source voltage $V_S$ reaches the node voltage $V_N$ minus the threshold voltage $V_T$ of the driving transistor 64. The current I through the emitter 46 will then be $I=V_S/R=(V_N-V_T)/R$. The emitter current I will be $I=(V_{COL}-V_T)/R$, because the node voltage $V_N$ is substantially equal to the voltage of the column signal $V_{COL}$. Assuming for the moment a fixed resistance R for the limiting resistor 66, the current I will be determined directly by the column signal $V_{COL}$.

At time $t_3$, shortly after the row signal $V_{ROW}$ goes high, the, row signal $V_{ROW}$ returns low, turning OFF the pass transistor 62. However, the node voltage $V_N$ remains at the level described above because the pass transistor 62 and driving transistor 64 present high impedances to trap the node voltage $V_N$ as stored charge on a parasitic capacitance 72 of the node 68. A short time later, at time $t_4$, the column signal $V_{COL}$ returns low. The changing column signal $V_{COL}$ does not affect the node voltage $V_N$, because the OFF pass transistor 62 isolates the column line 60 from the node 68.

At time $t_5$, a new sample of the column signal $V_{COL}$ is applied to the pass transistor 62. However, the node voltage $V_N$ remains constant, because the pass transistor 62 is still OFF. A short time later, at time $t_6$, the node voltage $V_N$ is refreshed when the row signal $V_{ROW}$ once again goes high, turning ON the pass transistor 62 and allowing the node voltage $V_N$ to rise, as described above. Thus, at the end of a refresh interval T, the node voltage $V_N$ establishes a new emitter current I equal to $I=(V_N-V_T)/R$.

The above description of operation assumes that the resistance R of the limiting resistor 66 remains constant. However, the limiting resistor 66 is typically formed as an integrated element in a common substrate with the emitters 46. For example, the limiting resistor 66 may be formed from a high resistance polysilicon resistor, from leaky, back-to-back diodes or from a single leaky diode. Such devices typically exhibit a negative temperature coefficient such that the resistance of such devices varies inversely in response to temperature changes. Thus, as the temperature of the display 40 rises, for example as may be caused by ambient temperature changes or by heavy activation of a region of the display 40, the resistance R of the limiting resistor 66 typically drops. Consequently, the rate at which electrons are emitted, and thus the brightness of the region of the display 40 may increase as temperature increases.

Figure 4:
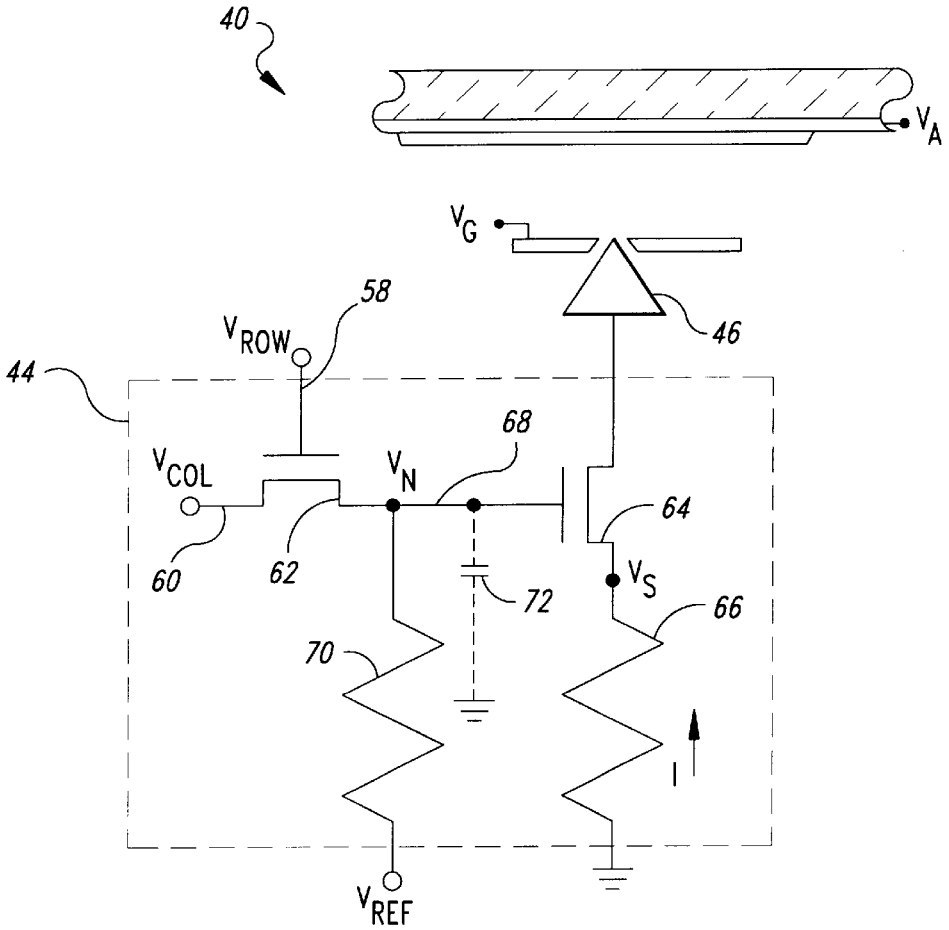
FIG. 4 is a schematic of a current control circuit used in the display of FIG. 1 and including a temperature compensating resistor.

FIG. 4 shows an embodiment of the current control circuit 44 that compensates for such temperature induced variations, where elements common to FIGS. 2 and 4 are numbered the same. Unlike the control circuit 44 of FIG. 2, the control circuit 44 of FIG. 4 includes a compensating resistor 70 coupled between the node 68 and a reference potential $V_{REF}$. Preferably, the reference potential $V_{REF}$ is ground.

Figure 5:
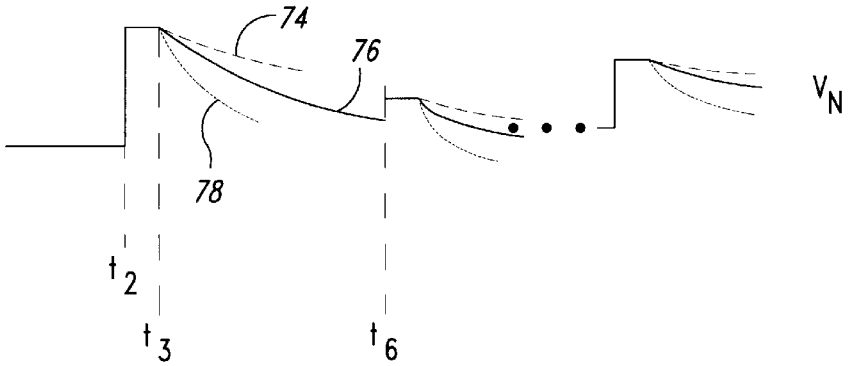
FIG. 5 is a signal timing diagram showing a controllably decaying node voltage within the current control circuit of FIG. 4.

The control circuit 44 of FIG. 4 responds to the same input signals $V_{ROW}$, $V_{COL}$ as the control circuit 44 of FIG. 2. However, the node voltage $V_N$ and the current I differ, as will be described with respect to FIGS. 3 and 5. As can be seen in FIG. 5, at time $t_2$ (when the row voltage $V_{ROW}$ goes high), the node voltage $V_N$ rises to the voltage of the column signal $V_{COL}$ and the node voltage $V_N$ remains at this level until time $t_3$, when the row signal $V_{ROW}$ turns OFF the pass transistor 62.

Unlike the embodiment described above with respect to FIG. 2, in this embodiment, the node voltage $V_N$ is not completely trapped at the node 68. Instead, the compensating resistor 70 provides a high impedance current path from the node 68 to the reference potential $V_{REF}$. The resistance $R_{70}$ of the compensating resistor 70 is sufficiently high that parasitic capacitance 72 (represented in broken lines in FIG. 4) of the node 68 discharges slowly. As a result, the node voltage $V_N$ decays slowly, as represented by the solid line 76 in FIG. 5. Since the voltage $V_S$ is equal to the difference between the node voltage $V_N$ and the threshold voltage $V_T$ of the driving transistor 64, the source voltage $V_S$ decreases along with the node voltage $V_N$ as the parasitic capacitance 72 discharges through the compensating resistor 70. For this reason, the emitter current I decreases slightly over the refresh interval T from the time $t_3$ when the row signal $V_{ROW}$ goes low to the time $t_6$ when the next pulse of the row signal $V_{ROW}$ arrives. The decreasing emitter current I reduces the intensity of emitted light slightly as compared to the embodiment of FIG. 2; but, the controller 42 compensates for the reduced intensity by increasing the voltage of the column signal $V_{COL}$ slightly. Thus, the overall light intensity is comparable to that of the embodiment of FIG. 2. To reduce the amount of compensation by the controller 42, the parasitic capacitance 72 can be supplemented by a discrete capacitor to increase the amount of charge stored at the node 68.

Although the emitter current I changes during the refresh interval T, the cathodoluminescent layer 56 responds relatively slowly, such that the intensity of light is determined by the total number of electrons striking the cathodoluminescent layer during the refresh interval T. Consequently, the slight variation in emitter current I is not visible to an observer.

The effects of temperature on the limiting resistor 66 are substantially mirrored in the compensating resistor 70, because the compensating resistor 70 and the limiting resistor 66 are formed in a common substrate. Thus, as the resistance R of the limiting resistor 66 falls, the resistance $R_{70}$ of the compensating resistor 70 also falls and as the resistance R of the limiting resistor 66 rises, the resistance $R_{70}$ of the compensating resistor 70 also rises. As a result, temperature-driven changes in the current I due to the limiting resistor 66 are offset by the effect of the compensating resistor 70, as can be seen from considering variations from a nominal operating point. For example, for a nominal node voltage $V_N$, the corresponding nominal source voltage $V_S$ will equal the nominal node voltage $V_N$ minus the threshold voltage $V_T$ of the driving transistor 64. If the resistance R of the limiting resistor 66 increases, the current I for the nominal source voltage $V_S$ will then decrease according to Ohm's law. However, an increase in the resistance R of the limiting resistor 66 will be tracked by a corresponding increase in the resistance $R_{70}$ of the compensating resistor 70. The increase in the compensating resistance $R_{70}$ slows decay of like node voltage $V_N$, as represented by the broken line 74 in FIG. 5. The slower decay of the source voltage $V_S$ maintains the average current I (i.e., the total number of electrons emitted during the refresh interval T) constant, thereby offsetting what would otherwise be a decrease in the current I caused by the increasing resistance R of the limiting resistor 66.

Similarly, if the resistance R of the limiting resistor 66 dropped, the current I through the limiting resistor 66 would be greater for a given source voltage $V_S$. However, the compensating resistor $R_{70}$ causes the node voltage $V_N$ (and thus the source voltage $V_S$) to decay more rapidly once the pass transistor 62 is turned OFF. This more rapid decay is shown in FIG. 5 by a dotted line 78. The lower source voltage $V_S$ once again causes the average current I to be maintained at a constant value, thereby offsetting what would otherwise be a current increase caused by the reduced resistance R of the limiting resistor 66. The compensating resistor 70 thus produces a counteracting temperature response to offset the temperature response of the limiting resistor 66.

While the principles of the invention have been illustrated by describing various structures for controlling current to the emitters 46, various modifications may be made without deviating from the spirit and scope of the invention. For example, the location and construction of the compensating resistor 70 can be varied. Additionally, one skilled in the art can adapt the concept discussed herein to address variations caused by other electrical and environmental effects. Additionally, the above-described structures and techniques can be adapted to a variety of other matrix addressable displays. Accordingly, the invention is not limited except as by the appended claims.

I claim:

1. A current control assembly for a light emitting assembly in a matrix addressable display, comprising:

a current limiting impedance having a thermal variation;

a driving circuit, including a driving transistor, configured to control current through the limiting impedance as a function of the magnitude of an input voltage, the driving circuit and limiting impedance being coupleable between the light emitting assembly and a first reference potential; and a bias circuit coupled to the driving circuit and configured to provide the input voltage to the driving circuit, the bias circuit including a biasing impedance coupled between an input terminal of the driving transistor and a second reference potential, the bias circuit having a thermal response selected to adjust the input voltage to counteract the thermal variation of the limiting impedance.

2. The current control assembly of claim 1 wherein the bias circuit, driving circuit and limiting impedance are integrated in a common substrate.

3. The current control assembly of claim 2 wherein the matrix addressable display is a field emission display and the light emitting assembly includes an emitter, wherein the common substrate carries the emitter.

4. The current control assembly of claim 1 wherein the biasing circuit further includes a discrete capacitor coupled to the driving circuit.

5. The current control assembly of claim 1 wherein the current limiting impedance includes a reverse biased diode.

6. The current control assembly of claim 5, further including a second diode coupled back-to-back with the reverse biased diode.

7. The current control assembly of claim 1 wherein the current limiting impedance is a resistor.

8. An image display apparatus, comprising:

a video signal generator; and a matrix addressable display including:

a viewing screen including a generally planar, transparent plate having a generally planar surface;

a transparent conductive anode on the planar surface, and a cathodoluminescent material covering the anode;

an emitter substrate adjacent the viewing screen including an emitter; and a current control assembly including:

a current limiting impedance having a thermal variation;

a driving circuit including a driving transistor and a limiting impedance, the driving circuit being configured to control current through the limiting impedance as a function of the magnitude of an input voltage, the driving circuit and limiting impedance being coupleable between the emitter and a first reference potential; and a bias circuit coupled to the video signal generator and the driving circuit and configured to provide the input voltage to the driving circuit, the bias circuit including a compensating impedance coupled between an input terminal of the driving transistor and a second reference potential, the limiting impedance and the compensating impedance having offsetting temperature responses to adjust the input voltage to counteract the thermal variation of the limiting impedance.

9. The image display apparatus of claim 8 wherein the limiting impedance and compensating impedance include semiconductor junctions.

10. The image display apparatus of claim 8 wherein the video signal generator is a television receiver.

11. A method of controlling current in a field emission display having a light-emitting assembly, comprising the steps of:

producing a biasing signal with a first circuit portion having a first temperature response;

in response to the biasing signal, limiting current flow to the light-emitting assembly with a second circuit portion having a second temperature response that offsets the first temperature response; and positioning the first circuit portion in thermal contact with the second circuit portion.

12. The method of claim 11 wherein the step of producing a biasing signal includes the step of producing a decaying biasing voltage.

13. The method of claim 12 wherein the step of producing a decaying biasing voltage includes:

producing an initial biasing voltage at a node;

isolating the node; and controllably bleeding charge from the node to produce the decaying biasing voltage.

14. The method of claim 13 wherein the first temperature response includes a temperature-induced variation in a rate of decay of the decaying biasing voltage.

15. The method of claim 11 wherein the step of limiting current flow to the light-emitting assembly includes providing a resistive current path between a reference potential and the light-emitting assembly.

16. The method of claim 15 wherein the second temperature response includes a temperature-induced change in resistance of the resistive current path and wherein the step of producing a biasing signal includes producing a decaying biasing voltage having a decay rate with a temperature-induced variation selected to offset the temperature-induced change in resistance of the resistive current path.

* * * * *

UNITED STATES PATENT AND TRADEMARK OFFICE

CERTIFICATE OF CORRECTION

PATENT NO. : 5,909,200
DATED : June 1, 1999
INVENTOR(S) : Hush

It is certified that error appears in the above-identified patent and that said Letters Patent is hereby corrected as shown below:

Column 6,
Line 10, "of like" should read -- of the --
Line 11, "FIG. 5" should read -- Fig. 6 --

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*